United States Patent [19]

Webber

[11] 4,274,484

[45] Jun. 23, 1981

[54] DUMP VALVE

[75] Inventor: Jack C. Webber, Houston, Tex.

[73] Assignee: Double Diamond Company, Mathis, Tex.

[21] Appl. No.: 88,343

[22] Filed: Oct. 26, 1979

[51] Int. Cl.[3] ..... E21B 37/10

[52] U.S. Cl. ..... 166/188; 137/68 R; 166/317; 417/319; 417/555 A

[58] Field of Search ..... 166/188, 317, 185, 177; 417/319, 555 A; 137/68 R

[56] References Cited

U.S. PATENT DOCUMENTS

| | | | |
|---|---|---|---|
| 2,854,929 | 10/1958 | McGowen, Jr. | 166/188 |
| 2,994,280 | 8/1961 | Duffin | 137/68 R X |
| 3,150,607 | 9/1964 | Riley | 417/319 X |
| 4,099,451 | 7/1978 | Blackwell | 166/202 X |
| 4,190,108 | 2/1980 | Webber | 166/202 |

*Primary Examiner*—William F. Pate, III

*Attorney, Agent, or Firm*—Vinson & Elkins

[57] ABSTRACT

Disclosed is an apparatus for swabbing wells. A cup type swab and dump valve are carried on the same mandrel. The dump valve protects the apparatus from excessive fluid load and drag.

15 Claims, 5 Drawing Figures

DUMP VALVE

This invention is related to the inventions shown in my U.S. Pat. No. 4,190,108, issued Feb. 26, 1980 which is incorporated herein in its entirety by reference.

This invention relates to the swabbing of wells and more particularly to the protection of wells during swabbing by dumping the load on a swab when undesirable pulling loads are experienced.

Wells have been swabbed for many years. Swabbing is done for many reasons such as removing fluid from a well to induce flow from a formation.

Many types of swab cups have been used in swab assemblies. Each type has its advantages and disadvantages. For instance, the wire reinforced swab cup has the advantage of being able to carry a substantial load of fluid, but the disadvantage of being more easily stuck in the well than nonreinforced swab cups. On the other hand, the nonreinforced cup, while more difficult to stick in the well, will normally not carry the same load as a reinforced cup.

Problems in swabbing are generally caused by two conditions. The first condition is running the swab under too great a load of fluid. The excess load tends to stick the cup to slow its movement upwardly in the well and increase settling out of solids suspended in the fluid which contribute to sticking of the cup. The excess load also tends to expand the cup into joints in the tubing which tend to destroy the cup and contribute to sticking problems.

The second problem is sticking of the cup due to excess drag between the tubing wall and the cup and column of packed solids above the cup. This is induced by solids suspended in the liquids such as sand settling out on top of and in the cup to greatly increase the drag of the cup on the tubing wall and cause the swab assembly to malfunction as by sticking or tearing up.

The above discussed problems can be greatly reduced by utilizing the swab cup disclosed herein and in my above identified application as this swab rubber has a minimal frictional engagement with the tubing.

It has been proposed in the past to dump the load on an overload swab cup by two methods. The first method is one that has been successfully used by the industry for many years. This method is shown in my U.S. Pat. Nos. 2,633,808 and 2,719,768. As shown in these patents an overload on the swab causes the webs to bend downwardly disengaging the tubing wall and dumping fluid. The other method which has been proposed but never successfully used is one in which a spring loaded valve operated by fluid pressure was proposed to dump the fluid above an overloaded swab. This proposal could not satisfactorily operate as the spring would permit the valve to weep and the abrasives in the fluid would cut the valve out. Further, such solution is only responsive to an overload of fluid and provides no solution to the problem of overloading due to drag between the swab cup and tubing wall. Thus, if a swab sands up and sticks due to excess friction between the swab and tubing wall the spring loaded dump valve would not relieve the problem as the valve only opened in response to pressure of fluid on the valve and not to load on the swab cup.

It is an object of this invention to provide a swab assembly having a dump valve responsive to fluid pressure and drag which will dump the fluid load should either fluid load or drag or the effect of both fluid load and drag become abnormal.

Another object is to provide a swab assembly in which upon fluid pressure and/or drag or both becoming abnormal the fluid load on the cup will be released and wash away foreign material causing abnormal drag.

Another object is to provide a dump valve responsive to both fluid pressure and drag in which upon the swab cup being subjected to an overload condition the fluid load will be dumped, permitting the pulling capabilities of the wireline truck to be concentrated on overcoming drag.

Another object is to provide a swab assembly and dump valve therefor wherein when the pressure load and the drag load are added together and amount to a selected amount a dump valve opens to wide open position and remains open to dump the fluid on the assembly.

Another object is to provide a dump valve for a swab assembly which opens in response to load on the swab and in which large fluid passages are opened to assist in washing away solid materials above the cup.

Another object is to provide a swab assembly which will handle a good overload but if the cup begins to crater from too much load or if it bumps at couplings from too much load or if it wears excessively the assembly will dump the fluid load on the assembly if the drag increases to a value at which the fluid load and drag exert a force in excess of a desired amount.

Another object is to provide a swab assembly which with normal drag and an overload may be pulled relatively slowly, but if pulled too rapidly will result in the load on the swab being dumped to protect the swab assembly and the pulling apparatus from damage.

Another object is to provide a swab assembly which will safely handle all normal swabbing, including high rates of pulling.

Another object is to provide a swab assembly in which the hazards in running the wire reinforced cups are reduced or eliminated.

Another object is to provide a swab assembly which when encountering overload conditions will dump the fluid above the cup and permit the assembly to be removed from the hole without tearing up the cup and leaving no debris in the hole.

Another object is to provide a swab assembly in which if the swab mandrel or sinker bars are bent causing the cup to run cockeyed and imposing an abnormal load on the cup the assembly will dump the fluid load above the cup permitting all pulling capabilities to be exerted on the cup to increase the probability of getting the cup out of the hole.

Another object is to provide a swab assembly in which a dump valve relieves the fluid load on a swab cup upon an excess force being exerted on the assembly and in which the interior of the swab cup is exposed to dumped fluid to wash solids from the interior of the cup.

Other objects, features and advantages of this invention will be apparent from the drawings, the specification and the claims.

In the drawings wherein like numerals indicated like parts and wherein several embodiments of this invention are shown:

Figure 1:
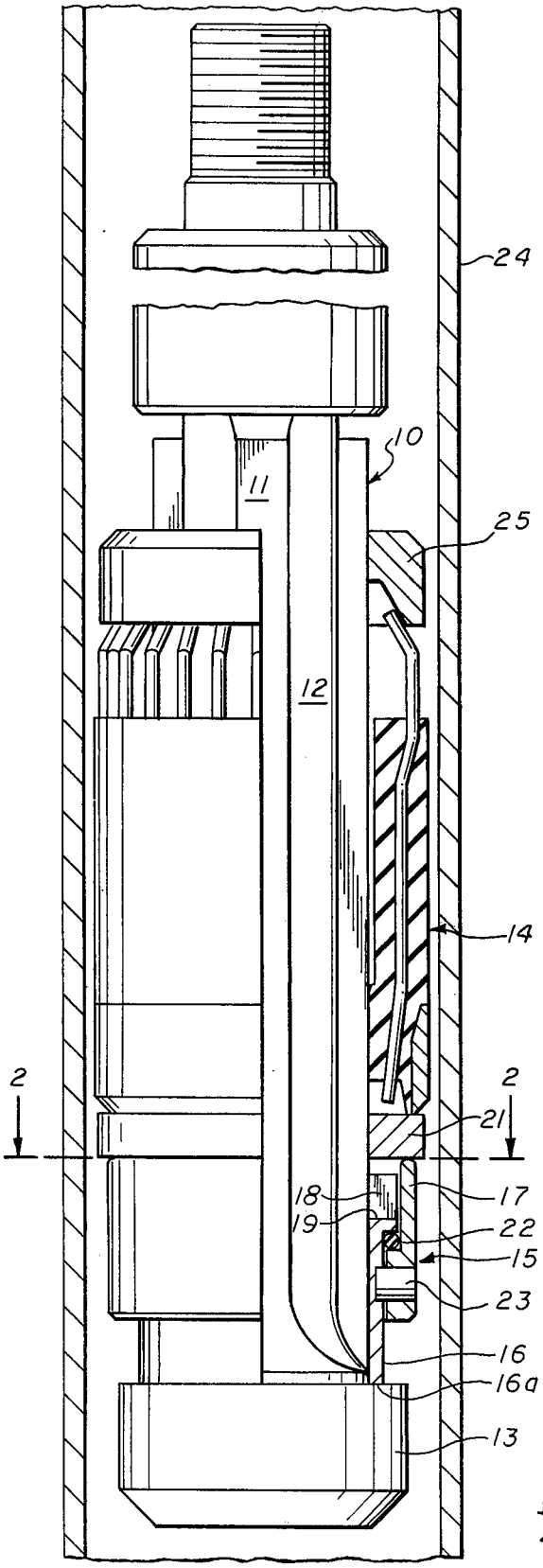
FIG. 1 is a view partly in elevation and partly in quarter section of a swab assembly in a tubing.

Referring first to FIG. 1, the swab assembly includes a conventional X-type mandrel 10 having longitudinally extending circumferentially spaced lands 11 and grooves 12 to provide a fluted structure which is closed at its lower end by the lower flange 13.

A conventional check valve mandrel as shown in my above identified application may be used by positioning the valve below the swab cup and providing a port in the wall of the mandrel to be controlled by the dump valve as taught herein.

A swab cup indicated generally at 14 is provided in the conventional manner on the swab mandrel 10. This swab cup may take any desired form but is preferably designed so that minimum friction is generated when the swab is in use and the opportunity for the swab cup to expand out into joints in the tubing and the like is minimized. A preferred form of swab cup is illustrated which will be described more in detail hereinafter.

A dump valve indicated generally at 15 is supported on the mandrel below the swab cup and controls flow through the flowways provided by the flutes in the mandrel as the assembly is moved upwardly. Of course, when the assembly is moving down in the hole to go under a load of fluid, the fluid can bypass the swab cup 14 on the exterior and also the swab cup 14 will tend to move upwardly on the mandrel permitting fluid to flow through the grooves 12 on the mandrel.

The dump valve 15 has a normally closed valve member which supports the swab cup and is movable to open position by the swab cup when the swab cup is subjected to a predetermined force. This force may be either or both of the drag on the swab cup 14 and the force exerted by the load of fluid above the cup and, of course, the force resulting from the upward pull on the swab assembly as it is pulled from the well by the conventional wireline equipment.

The dump valve may be designed in any desired way in which the load on the swab cup, both drag and fluid, is supported by the valve member. Whether the valve member be engaged with the cup or with the mandrel is not critical so long as the load on the cup is imposed on the valve member and the valve member and the remainder of the dump valve be moved relative to each other in response to an excess load. In other words, the valve member may physically move to open position or the valve member may stay in one position and the remainder of the dump valve be moved relative to the valve member to position the valve member in open position.

The dump valve shown at 15 includes a valve body 16 and a valve member 17. The valve body 16 has flowways provided by spaced lands 18 and grooves 19. Flow through these grooves is prevented by the valve member 17.

The dump valve body 16 at its lower surface 16*a* engages the flange 13 on the bottom of the mandrel and prevents any significant flow between the valve and mandrel when these parts are engaged. The valve member 17 engages a support ring 21 for the swab cup 14 and prevents any significant flow between these two parts when they are engaged, that is, during the pulling operation.

Means of any desired form may be provided between the valve body and valve member to prevent flow therebetween while the valve member 17 is in the closed position. In the FIG. 1 form of the invention the seal means is provided by an O-ring 22.

The valve member 17 is held in closed position by any desired means until a selected force is applied to the valve member 17 by the forces exerted on the swab cup 14. When a selected force is applied to the valve member 17, it is released and moves to its open position.

The means for holding the valve member in closed position should be one which when released permits the valve to move to complete open position and stay in open position so that weeping through the valve does not result. In other words, the valve member should move to its full open position so that the fluid load above may be dumped through full open ports to wash out solid materials which may have accumulated above the swab cup 14. Thus, the release means may be any type which will provide a complete release under load such as a collet, a detent, a frangible member, or the like.

In FIG. 1 the release means is provided by a shear pin 23 which when the load on the cup reaches the design force will shear to release the valve member 17 from the valve body 16. When this occurs the valve member 17 will drop down to and be supported on the flange 13 due to its own weight and will be urged in this direction by the initial downward force on the valve member at the time the shear pin shears and, of course, by the fluid load acting downwardly on the valve member 17.

After the pin 23 shears, the valve cup moves downwardly relative to the mandrel 10 a short distance until supports between the valve body 16 and the ring 21 function to stop such movement and hold the ring 21 in position to permit flow through the dump valve. In the FIG. 1 form of the invention, the lands 18 support the ring 21 on the top of the lands to permit flow through the flowways provided by the grooves 19 between adjacent lands.

Figure 2:
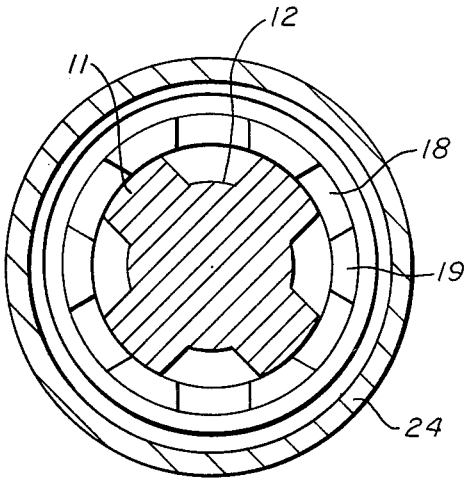
FIG. 2 is a view along the lines 2—2 of FIG. 1.

Preferably, these flowways 18 are large spaces as shown in FIGS. 1 and 2 and the fluid load above the swab is released to flow through these large volume ports. Such flow will wash out solid matter, such as sand, which may have accumulated between the swab cup and mandrel 10 and which may have accumulated for some distance above the swab cup. The large flow ports in the dump valve give every opportunity for the fluid above the swab to wash the accumulated solid matter down past the dump valve and relieve the swab cup from the problem of this solid matter tending to stick the assembly in the tubing 24. In any event the fluid load above the swab cup is relieved and all of the power available in the pulling assembly may be utilized to move the swab assembly to the surface.

The cap 25 is slidable on the mandrel 10 above the cup and protects the upper extremity of the swab cup 14 from hanging in the wellhead.

Figure 3:
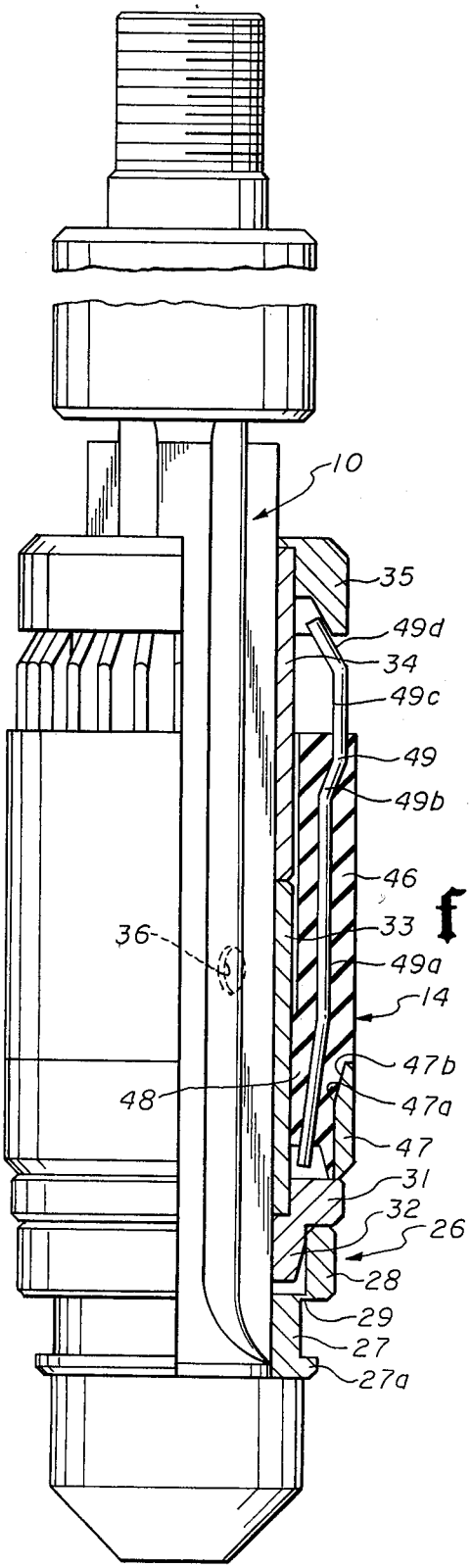
FIG. 3 is a view similar to FIG. 1 showing another embodiment of this invention.

Another form of dump valve is shown at 26 in FIG. 3. In this form the valve body is provided by the annular ring 27 and the valve member is provided by the annular ring 28. These rings are concentric with each other. This form substitutes for the frangible shear pin 23 and the O-ring 22 a frangible web 29 which is impervious and interconnects the rings 27 and 28. This web, of course, frangible in response to a selected force, but until such time as such force is exerted on the web it seals between the two rings 27 and 28 and supports the swab cup supporting flange 31. The web is preferably formed of the same material as the rings. Other material could be used such as synthetic rubber member bonded or cemented to the two rings.

Upon the swab cup being exposed to a selected force due to sand and/or the fluid load this force is transmitted through the valve member 28 to the frangible web 29 which is then ruptured permitting the valve member 28 to move downwardly over the ring 27. To avoid any debris in the well the ring 27 has an outwardly extending flange 27*a* which will catch the valve ring 28 and bring it to the surface with the swab assembly.

In this form of the invention the spaced lands to support the ring 31 after the dump valve is moved to open position are provided by circumferentially extending alternate lands and grooves on the ring member 31. One of these lands is shown at 32. Thus, when the swab cup is subjected to an excess load it moves downwardly rupturing the frangible web 29 moving the valve member 28 to open position and the swab ring 31 is supported by the lands 32 and flow from the flutes on the mandrel 10 passes out through the grooves between the lands 32. These grooves are not shown but the configuration may follow that shown in FIG. 2.

The lower swab flange ring 31 is shown to have an upstanding sleeve 33 between the swab cup mandrel.

Another sleeve 34 supports the protecting ring 35 above the swab cup 14. With this construction the mandrel 14 can be of greater length and more than one swab cup can be utilized as they can be stacked one on top of the other. It is sometimes preferred to run multiple swabs in very deep swabbing operations or other operations where it is feared that one cup might not be able to return to the surface in operating condition. In such circumstances more than one cup is used and the load tends to be transferred from one cup to another as they wear and the operator has a better chance of getting to the surface with at least on cup still functional to bring the load to the surface.

It is believed that in most instances the removal of sand and other debris from above the cup will be sufficient to permit the operator to retrieve the swab assembly. Added protection may be provided where sleeves are utilized by providing ports such as shown in dashed outline at 36 to wash debris from the interior of the cup. These ported sleeves may be used where a single swab cup utilizes the sleeve form of the invention or where each swab cup used is carried by a separate mandrel and protected by a dump valve on the same mandrel.

Many standard X-type mandrels are in the field and the present commercial form of the swab 14 is utilized with the spacer provided by the sleeves 33 and 34. With the form of invention shown in FIG. 1, if the same swab cup 14 be used then the fluted mandrel may be larger and take up the space occupied by the sleeves as shown in FIG. 1.

Figure 4:
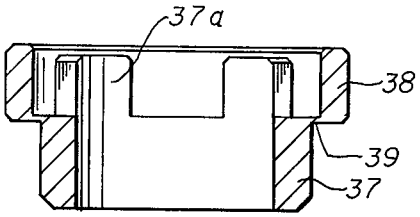
FIG. 4 is a cross-sectional view through another form of a dump valve which may be utilized with this invention.

A still further form of dump valve is shown in FIG. 4. In this form the valve body 37 is joined to the valve member 38 by the frangible web 39 generally in the same manner as disclosed in FIG. 3. In this form of the invention lands 37*a* support the swab cup after the valve has moved into open position. The lands 37*a* are carried on the valve body 37 and extend upwardly similar to the arrangement shown in FIG. 1.

Figure 5:
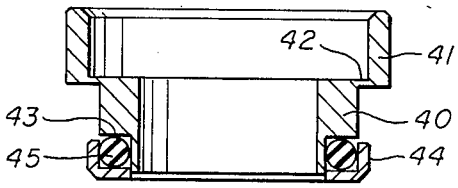
FIG. 5 is a still further form of dump valve which may be utilized with this invention.

It may be desirable to protect the dump valve from the imposition of a sudden shock load which might rupture the frangible member. Such a shock could occur if the operator initially exerted a sudden hard upward pull on the valve assembly. To absorb such a shock the dump valve may take the configuration shown in FIG. 5. In this form of the invention the valve body 40 has the valve member 41 secured thereto by the frangible member 42. The operation of the valve is as hereinbefore explained. The lower end of the valve body 40 is provided with an external undercut 43 to provide a groove opening to the bottom edge of the body. An upwardly facing cup 44 is slidable about this groove. An O-ring 45 is positioned between the groove 43 and the cup 44. Preferably, the upper and lower surface of the O-ring is attached to the body and the cup 44 with a small amount of glue so that if the parts move upwardly while the assembly is being run into the well the body, O-ring, and cup will retain the relationship shown in FIG. 5.

As load is applied to the swab assembly to bring it out of the well the O-ring 45 is compressed between the cup 44 and the body 40 and thus provides a means of absorbing any sudden shock that may be applied to the swab assembly when an upward load is first applied to the assembly.

The cup includes a sleeve shaped body 46 of resilient material. Preferably, the inner and outer diameter of the body are substantially constant down to a point adjacent ring 47. In the area of ring 47 the outer diameter of the body is reduced to accommodate the ring 47. The inner diameter of the body is slightly reduced at 48 to engage sleeve 33 where the sleeve is employed. This centers the swab rubber. This is desirable to prevent problems as the cup passes upwardly through the wellhead. The additional material above the ring 47 also increases wall thickness above ring 47 at the point of maximum wear to protect against blowout at this point.

The body is designed to run with fluid film lubrication over most of its length, and has an adequate length for this purpose. By providing a design which utilizes fluid film lubrication, the frictional resistance to movement of the cup through the tubing is greatly reduced. This results in less wear on the cup and less power required to lift a given load.

Providing support for the resilient body 46 are a plurality of wires 49 which extend the entire length of the body in the illustrated embodiment. These wires are arranged circumferentially about the cup and spaced equidistant from each other. In accordance with this invention the principal portion of the wires which is embedded within the resilient material 46 is spaced inwardly from the outer periphery of the body 46 so as not interfere with the fluid film lubrication and to not engage the wall of the tubing. If the wires engage the tubing in this area of the cup the frictional drag would be greatly increased.

Each wire 49 includes a lower section 49*a* which extends upwardly through a substantial length of the body. Above this point the lower intermediate section of the wire 49*b* angles outwardly to position the upper intermediate portion of the wire 49*c* at approximately the outer diameter of the cup body 46. Above the upper intermediate portion the top portion 49*d* of the wires angles inwardly to avoid the wires catching on the tubing, particularly at joints or coliars. The upper intermediate portion 49*c* and the top portion 49*d* of the wires provides a sled-like structure which will bridge the space between joints of tubing where they are connected together, as by couplings. As the body 46 comes up to approximately the juncture between the lower intermediate portion of the wire 49*b* and the upper intermediate portion of the wire 49*c* the support for the body 46 begins at this bridging section of the wires and the wires thus act in cantilever fashion to prevent the body 46 from bulging outwardly as a crevasse in the tubing is being crossed to prevent the body from extruding out into the crevasse and being damaged therein. Couplings between tubings result in such a crevasse approximately every thirty feet. The design of the cup shown in the drawings is such that the operator cannot feel the couplings as the swab is pulled up the tubing.

It will be noted that except with very light loads the portion 49*c* of the wires which contact the tubing bear very lightly against the pipe. The principal load carrying portion of the cup is below the upper intermediate section 49*c* of the wires and thus the load exerted radially on the cup is below section 49*c* of the wires and the frictional load between section 49*c* of the wires and the tubing is very small. This principle reduces the wear on the wires and thus virtually eliminates wire breakage and sticking due to wire wear.

The relationship of the radial dimension of the wires and the material at the top of the cup and the relative arrangement are preferably arranged such that the radial dimension of the wires and the radial dimension of the cup inside and outside of the wire in a radial direction are approximately equal. In the illustrated form the outer section of the cup and wires are approximately equal and the inner section of the cup is approximately two-thirds of the wire width. This will give adequate resilient material radially outward from the wires to provide the fluid film lubrication and will give adequate material for providing a long wear life for the cup. The material is also thick enough that the supporting forces from individual wires are spread fairly evenly about the periphery of the cup.

In a two inch swab it is preferred to utilize twenty-four 0.120" diameter wires. It is noted that while round wires are illustrated other shapes such as square wires could be utilized. With the round wires of the state diameter there is preferably 0.110" of material of the body radially outward from the lower section 49*a* of the wires throughout most of the length of the body. Along this section of the body the radial dimension of the innermost section of the wall of the body 46 is 0.080". This amount of material internally of the wires is sufficient to preclude blowing through the wires under load and gives satisfactory material for molding. The amount of material inwardly from the wires could be less and give the function of preventing blowing through the wires but the slight increase to about the statement dimension gives some tolerance in the molding procedure and permits acceptance of cups with slight molding flaws.

At the lower end of the cup a retaining ring 47 is provided which supports and retains the lower end of the cup. This ring is preferably spaced radially from the lower end of the wires 49 to permit radial outward movement of the wires when the cup is under load. The ring 47 might take any form such as the ring-like structure shown or it might be a bushing with oversized holes or holes which are oval with their major dimension extending radially. The purpose in either case would be to permit the wires to move radially outward under load so that the wires do not unduly restrain the ability of the body of resilient material to expand radially into contact with the tubing.

The wires may be restrained against movement in a radial dimension by pivoting the wires at the restraining ring 47. That is, the wires would engage the inner surface of the ring 47 and turn about the circumferentially extending edge 47*a* provided by the chamfer 47*b*. This would result in the wires moving radially immediately above the ring 47 is substantially the same manner as when the wires are spaced from the ring 47. It may be found that the cup would need to be slightly longer to obtain the desired length of cup for fluid film lubrication. It has been found that in some cases the lower ends of the wires have scored the sleeve 33 indicating that the wires first move out and then pivot about the circumferential edge 47*a*.

It will be noted that the ring 47, the body of material 46, and the upper intermediate section 49*c* of the wires are all positioned so that the outer peripheral surface of these parts are approximately at the same diameter. With the design illustrated the cup can be slightly less in diameter than other conventional wire supported cups which will permit the cup to go down into the well faster and to negotiate tight spots in the tubing with greater ease.

It will be noted that the wires 49 at their lower ends are in a space. This is due to a wire supporting mold part being used at this point during the molding procedure. It will also be noted that the wires terminate a slight distance above the ring 47. This is to insure that the wires do not inhibit the ability of the ring 47 to seat on the flange therebelow of the lower support and provide a metal-to-metal seat at this point. It might be noted that the body 46 extends down to the bottom of ring 47. While this is not necessary it is preferable as the resilient material will assist the ring in providing a seal with the support ring therebelow.

For clarity of disclosure the body 46 is shown to terminate at the upper portion of the upper intermediate section 49*c* of the wires. In the commercial form of this cup a gear-like member is utilized at the top of the cup during the molding procedure. The lands of the gear extend between the several wires to hold them in proper relationship. This results in the body 46 actually extending up to the top of the wires and inwardly from the wires along the section of the wires above the body as shown in the drawings. However, the gear-like mold member extends between each pair of adjacent wires and there is no resilient material at this point other than a film of material which may sometimes extend around the entire outer periphery of the wires at this point. This resilient material above the point shown in the drawings is non-functional and thus has been omitted for clarity of understanding of the invention. While the mold system which has been utilized with the swab of this invention results in the deposit of non-functional material at the top section of the wires, it will be appreciated that other mold design might readily avoid leaving resilient material above the point of the resilient material shown in the drawing. In any event material above this point is not functional as it is not continuous about the entire wall of the cup.

From the above it will be appreciated that the swab cup can be made smaller than the conventional wire supported cup. Then with both ends of the supporting wires being free to move radially on the bottom end to pivot the cup can readily expand radially into engagement with the tubing when under load. When the cup is expanded into engagement with the wall of a tubing the upper intermediate section 49*c* of the wires bridge any gap or crevasse in the tubing and provide cantilever support for the resilient body of the cup to prevent or lessen the probability of damage as the cup passes a crevasse in the tubing.

From the above it will be seen that while wire cups have generally been regarded as hazardous to run that this hazard may be overcome. Well before an unsafe pull occurs on the rope socket the drag or fluid load trips the dump valve. At once large fluid passages are opened for flow of sand and fluid. This relieves the fluid load above the cup and washes away as much of the sand as possible to permit the operator to have a better chance of recovering the swab assembly.

The swab cup preferably should be designed to avoid premature opening of the dump valve. In other words the cup should be a low drag cup and it should be protected from bumping against couplings and the like. After the cup is worn it should also be replaced to maintain the low drag conditions to avoid premature operation of the dump valve. If, however, the operator runs a cup too long resulting in a high drag cup it is likely that the dump valve will be actuated before the cup fails and becomes difficult to remove from the hole thus protecting the operator against the results of using a cup too long.

The foregoing disclosure and description of the invention are illustrative and explanatory thereof and various changes in the size, shape and materials, as well as in the details of the illustrated construction, may be made within the scope of the appended claims without departing from the spirit of the invention.

The term "swab cup" as used herein refers to any piston-like member used to swab a well.

What is claimed is:

1. A swab assembly comprising,
a mandrel having a flowway therethrough,
a swab cup on the mandrel, and
a dump valve supported on the mandrel below the swab cup controlling flow through said flowway as the assembly is moved upwardly,
said dump valve having a normally closed valve member supporting said swab cup and positionable in open position by said swab cup when said swab cup is subjected to a predetermined force,
said dump valve having inner and outer concentric rings with the outer ring slidable over the inner ring,
one of the rings providing said valve member,
frangible means between the inner and outer rings supporting said valve member in upper position relative to the other ring, and
means sealing between the rings when said valve member is held in upper position.

2. The swab assembly of claim 1 wherein,
the frangible member is a shear pin, and
the seal means is a sliding seal between the inner and outer rings.

3. The swab assembly of claim 1 wherein,
the frangible means and seal means is provided by a circumferentially extending impervious frangible web interconnecting the two rings and sealing therebetween until the web is ruptured.

4. The swab assembly of claims 1, 2 or 3 wherein,
one of the inner and outer rings and the bottom of the swab cup has circumferentially arranged spaced lands and grooves transmitting the load between the valve and swab cup when said valve member is in open position.

5. The swab assembly of claims 1, 2 or 3 wherein,
said dump valve is provided wth shock absorber means absorbing any sudden shock as the assembly is placed under load.

6. The swab assembly of claims 1, 2 or 3 wherein,
the swab cup is a wire reinforced cup of resilient material.

7. The swab assembly of claims 2 or 3 wherein the swab cup comprises,
a sleeve-shaped body of resilient material with circumferentially spaced reinforcing wires, all of said wires spaced inwardly from the outer diameter of the body along a major portion of its length to permit the body to have fluid film lubrication with a tubing,
said wires at their upper sections having sled portions at the outer diameter of the cup for engaging the wall of a tubing and bridging couplings in the tubing, and
a restraining ring at the lower end of the cup limiting radial movement of the wires within the ring while permitting limited outward movement of the wires above the ring.

8. The swab assembly of claims 1, 2 or 3 wherein the swab cup comprises,
a sleeve-shaped body of resilient material,
a plurality of wires extending lengthwise of and equally spaced about the body,
each wire having a lower portion extending through a substantial length of the body at approximately the radial midpoint of the wall of the body, and
an intermediate portion at the upper section of the body with its outer surface approximately in a plane tangent to the outer surface of the body and an upper portion angled inwardly, and
a rigid ring surrounding the lower end of the body and the lower ends of the wires and spaced radially from the wires to permit limited outward movement of the wires.

9. The swab assembly of claim 1, 2 or 3 wherein the interior of the swab cup is exposed to dumped fluids.

10. A swab assembly comprising,
a mandrel having a flowway therethrough,
a swab cup on the mandrel comprising, a sleeve-shaped body of resilient material with circumferentially spaced reinforcing wires, all of said wires spaced inwardly from the outer diameter of the body along a major portion of its length to permit the body to have fluid film lubrication with a tubing, said wires at their upper sections having sled portions at the outer diameter of the cup for engaging the wall of a tubing and bridging couplings in the tubing, and a restraining ring at the lower end of the cup limiting radial movement of the wires within the ring while permitting limited outward movement of the wires about the ring, and
a dump valve supported on the mandrel below the swab cup controlling flow through said flowway as the assembly is moved upwardly, said dump valve having a normally closed valve supporting said swab cup and positionable in open position by said swab cup when said swab cup is subjected to a predetermined force,
said dump valve having inner and outer concentric rings with the outer ring slidable over the inner ring,
one of the rings providing said valve member, frangible means between the inner and outer rings supporting said valve member in upper position relative to the other ring, and means sealing between the rings when said valve member is held in upper position.

11. The swab assembly of claim 10 wherein, one of the inner and outer rings and the bottom of the swab cup has circumferentially arranged spaced lands and grooves transmitting the load between the valve and swab cup when said valve member is in open position.

12. As a subcombination a dump valve for a swab assembly comprising, inner and outer concentric rings with the outer ring slidable over the inner ring, one of the rings providing a valve member, releasable means between the inner and outer rings supporting said valve member in spaced position relative to the outer ring, and said releasable means provided by a circumferentially extending impervious frangible web interconnecting the two rings and sealing therebetween until the web is ruptured.

13. As a subcombination a dump valve for a swab assembly comprising, inner and outer concentric rings with the outer ring slidable over the inner ring, one of the rings providing a valve member, releasable means between the inner and outer rings supporting said valve member in spaced position relative to the outer ring, and means sealing between the rings when said valve member is in spaced position, and shocked absorber means absorbing any sudden shock as the assembly is placed under load.

14. The subcombination of claims 12 or 13 in combination with a swab support ring, one of said swab support ring, said inner ring, and said outer ring having circumferentially arranged spaced lands and grooves transmitting the load between said swab support ring and said valve when said valve member is in said open position.

15. The subcombination of claims 12 or 13 in which one of said rings is provided with circumferentially arranged spaced lands and grooves transmitting the load on said dump valve when said valve member is in said open position.

* * * * *